United States Patent [19]

Moore

[11] Patent Number: 4,614,392

[45] Date of Patent: Sep. 30, 1986

[54] WELL BORE ELECTRIC PUMP POWER CABLE CONNECTOR FOR MULTIPLE INDIVIDUAL, INSULATED CONDUCTORS OF A PUMP POWER CABLE

[76] Inventor: Boyd B. Moore, 427 Mignon, Houston, Tex. 77024

[21] Appl. No.: 691,550

[22] Filed: Jan. 15, 1985

[51] Int. Cl.[4] ..... H01R 4/00

[52] U.S. Cl. ..... 339/94 R; 339/60 R; 339/213 R; 174/91

[58] Field of Search ..... 339/94, 177, 213 R, 339/59-63, DIG. 2, 147 R; 174/91, 84 R

[56] References Cited

U.S. PATENT DOCUMENTS

| | | | |
|---|---|---|---|
| 2,710,385 | 6/1955 | Sprigg | 339/60 R |
| 2,967,795 | 1/1961 | Bollmeier et al. | 174/84 R |
| 3,085,138 | 4/1963 | Brown et al. | 339/147 R |
| 3,109,690 | 11/1963 | Stevens, Jr. | 339/60 R |
| 3,124,405 | 3/1964 | Massa | 339/60 R |
| 3,187,088 | 1/1965 | Warner | 174/91 |
| 3,317,882 | 5/1967 | Schumacher | 339/177 R |

*Primary Examiner*—Gil Weidenfeld
*Assistant Examiner*—David L. Pirlot
*Attorney, Agent, or Firm*—Jack W. Hayden

[57] ABSTRACT

A well bore pump electric power cable connector for field application to connect between the noninsulated ends extending from individual, insulated electric conductors of a high voltage pump power cable includes male and female elastomer boots each having a central passage therethrough to receive an end of the conductor to connect the noninsulated ends thereof, respectively, with a male electric conductor contact pin and female electric conductor socket in the male and female boots. The central passage has spaced shoulder means to mate spaced shoulder means on the male contact pin and female socket to retain them in the boots. Annular, longitudinally extending seal surface sealingly engage when the boots are mated and cooperating stop surface means and locked surface means engage when the boots are mated. A protective compression cover encloses the mated boots and the adjacent conductor portions to inhibit expansion of the mated boots in well bore fluids and thereby increase the seal effect between the insulated conductor extended into the mated boots, the conductor pin and socket and between the mated boots.

2 Claims, 5 Drawing Figures

FIG. 4
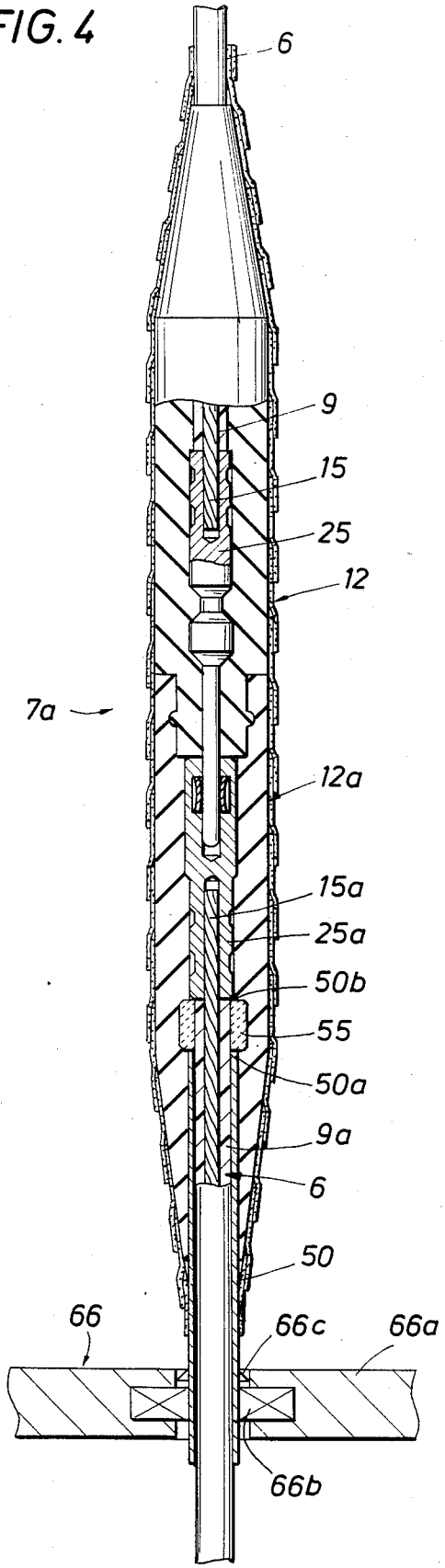
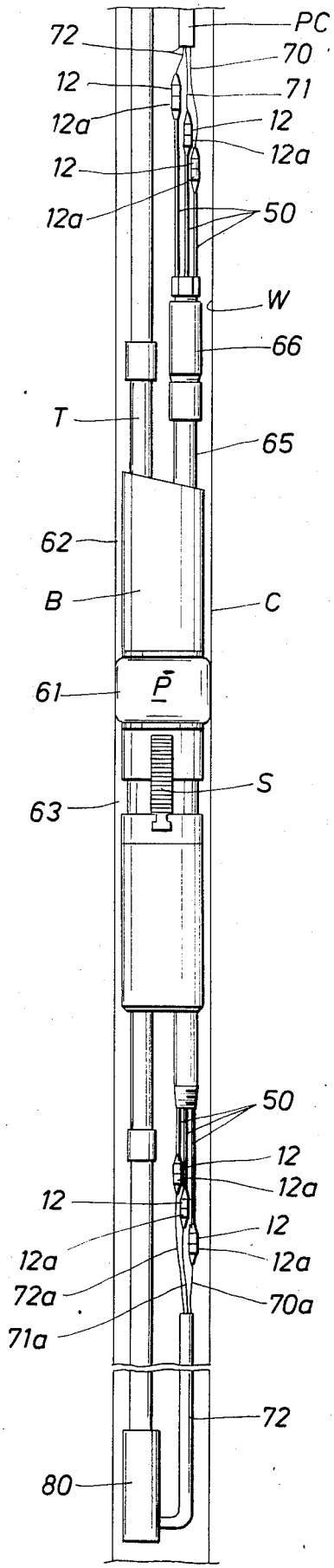
FIG. 5

WELL BORE ELECTRIC PUMP POWER CABLE CONNECTOR FOR MULTIPLE INDIVIDUAL, INSULATED CONDUCTORS OF A PUMP POWER CABLE

CROSS REFERENCE TO RELATED APPLICATIONS

This invention relates to subject matter in my prior copending application bearing Ser. No. 691,556 filed Jan. 15, 1985 for "WELL BORE PUMP POWER CABLE SPLICE ARRANGEMENT" and Ser. No. 691,558 filed Jan. 15, 1985 for "WELL BORE BARRIER PENETRATOR ARRANGEMENT AND METHOD FOR MULTIPLE CONDUCTOR PUMP POWER CABLE".

FIELD OF THE INVENTION

Heretofore, power cables for well pumps employing multiple conductors capable of handling the high voltage range (115–5000 volts) required for operating a well bore pump and the electric conductors have been spliced or connected by hand forming and wrapping the splices in the field on the well location prior to lowering the power cable and pump into the well. It can be appreciated that this procedure requires substantial skill and technique on the part of the servicemen performing the operation, and also is very time consuming and expensive. Not only is the time of the servicemen involved, but additional fieldhands and additional equipment are required to handle the cable and the pump during the lowering operations, the equipment and personnel which must stand by as each splice in each electric conductor of a multiple power cable is attempted.

Furthermore such operations are difficult, if not substantially impossible, to perform in rain or snow as water may be trapped within the material forming the splice as the splice is being formed. This condition may not be readily apparent, or may be overlooked in the field applications of connecting the exposed ends of electric conductors in an endeavor to get the job completed and the well back in operation as soon as possible. However, the presence of moisture in the material may subject the field splice formed under such conditions to failure after it is inserted in the well, thus requiring that the pump and cable again be removed and another splicing operation attempted.

The time required to hand wrap or splice the individual cables of a power cable for a well pump is substantial, thus tying up substantial equipment and requiring substantial man hours. Further, the success or failure of the splice is not necessarily apparent at the conclusion of its formation for the reasons noted hereinabove, and the failure rate of conductors in a power cable for a well pump are substantial. While splices of the above type have been longitudinally spaced in a multiple conductor cable, they have not been capable of withstanding the well bore pressures and fluids or of being suitably received in the well bore while being of a size so as to be nonrestrictive.

Another means of attempting to overcome the above problem in forming a splice in a pump power cable for a well bore has been to prefabricate or mold a connector means on the multiple conductors of a power cable in the same longitudinal position or elevation of the power cable which positions all of the mass of the connection at the same elevation in the well bore. However, this means and method provides a connector which limits the electric power that may be transmited to the pump, since the connector is formed on the multiple electric conductors of the power cables at the same position and in order to try to keep it of sufficiently small diameter so that it can fit reasonably within the limits of the well bore, the insulation between the multiple electric conductors and the contacts engaging each electrical conductor are so small that substantial problems are created when sufficient power is applied to the power cable for transmission to operate the electric pump.

Still another means presently employed for electric power cable connections of a well pump is to try to apply molded connectors of various configurations to the pump power cable individual conductors in the field. However, these heretofore generally been extremely difficult to install and generally required special compounds to try to effect a seal between the molded connectors and the electric conductor to prevent well fluids from entering the insulated portion of the connector and thereby shorting the conductors to ground through the well fluid.

Other present devices attempt to mold elastomer or plastic to the electrical conductors of the power cable to seal the individual conductors from the well fluids, but this procedure requires a long time and too much technique to install.

Generally speaking, all devices presently employed in attempt to splice or connect the multiple conductors of a power cable with a pump to be lowered in a well bore may have a substantial failure rate in use in wells, require a long time and may be difficult to assemble which is extremely expensive and which require substantial expense in actual installation due to the necessity of maintaining the oilfield equipment including rigs on a standby basis along with the necessary support personnel while the power leads from the pump are attempted to be spliced or connected with the electric conductor of the power cable.

BRIEF DESCRIPTION OF THE INVENTION

The present invention solves the above and other problems presently encountered in attempting to connect the multiple conductors of a power cable with power leads to a well pump in field operation by providing a connector for each individual electric conductor and an insulation arrangement which seals each electric conductor. The male and female boots are provided with central passages therethrough for receiving an insulated end of an electric conductor of the power cable in one end of each boot with an exposed noninsulated end thereon for engaging with the male and female electric connectors.

The central passage is provided with longitudinally spaced shoulder means for engaging with mating longitudinal spaced shoulder means on the male and female electric conductor whereupon the boots may be positioned over the electric conductors and retained thereon by reason of engagement of the shoulder means in the central passage and the mating shoulder means on the male and female electric conductor.

Annular, longitudinally extending seal surfaces sealingly engage when the boots are mated and cooperting stop surface means and lock surface means engage when the boots are mated to secure the boots together. A protective compression cover encloses the mated boots to inhibit expansion thereof in well bore fluids which tend to expand elastomers. This increases the seal pressure and seal effect between the mated boots and also between the mated boots and the insulated cable extending therein. The protective cover also inhibits explosion of the elastomer connector when the well bore is pumped down, or when the the pump is removed from the well bore which heretofore has created substantial problems since elastomer subjected to hydrocarbons absorbs gas and causes swelling. When the well is pumped off or when the devices are removed, exposing the connectors to the air, the trapped gas in the elastomer tries to escape, and the elastomer boots decompress. Devices of the prior art have been subjected to destruction by attempts of the hydrocarbon gases and other fluids to suddenly try to escape from the elastomer conductors, thus ripping them apart. The protector cover of the present invention encloses the male and female boots so that as the elastomer tends to expand, this expansion is employed to increase the seal of the conductor with the electric conductors of the power cables. Also, the protective cover enables the well fluid absorbed therein to seep or leak therefrom in an orderly fashion to prevent destruction of the connector and to maintain a proper seal when it is retained in the well bore.

Further, the connector of the present arrangement may be readily and easily applied in the field and is applied to the individual electric conductors at different longitudinal positions therealong so that a larger amount of insulation may be employed in each connector without providing any undue restriction in the well bore to inhibit proper lowering of the well pump into the well bore and positioning thereof as desired. This enables full power to be delivered through the power cable to well pump without damage to the connector and to accommodate proper operation of the pump over an extended period of time.

Other objects and advantages of the present invention will become more readily apparent from a consideration of the following description and drawings.

BRIEF DESCRIPTION OF THE DRAWINGS

FIG. 4 is an embodiment of the present invention wherein the connector is employed with a power cable having a steel tube over the insulation for passing through a barrier such as a packer, wellhead or the like with the packer as the barrier being shown in FIG. 5;

FIG. 5 is a schematic illustration illustrating in detail the arrangement of the connectors of the present invention at different longitudinal positions on the electric conductors of a multiple conductor pump power cable for forming a splice to enable the conductors on one side of a barrier to be connected to a surface power source and to pass through the well bore barrier for connection on the other side thereof for connection with the well pump power leads.

BRIEF DESCRIPTION OF THE EMBODIMENTS

Figure 1:
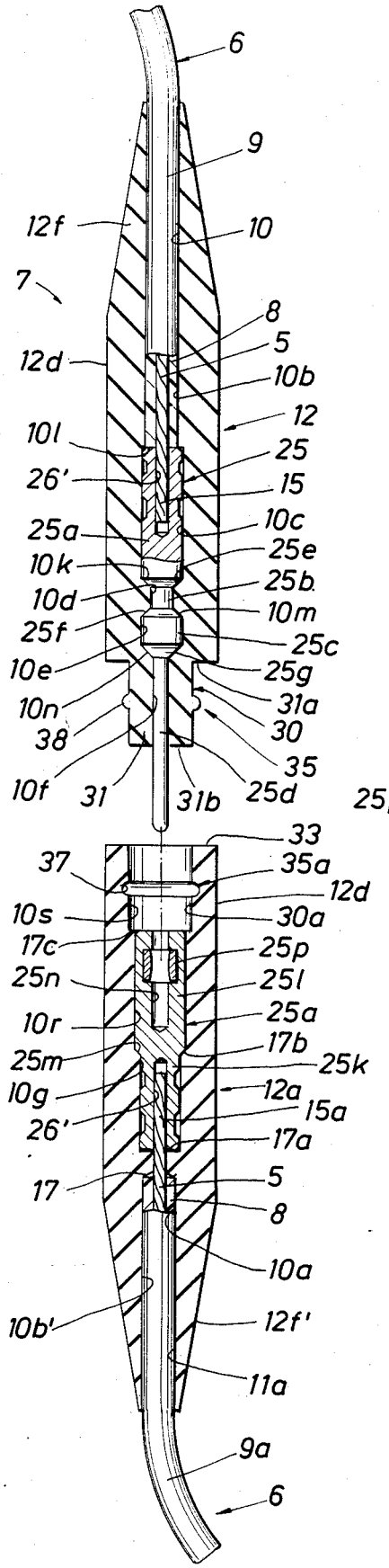
FIG. 1 is a vertical sectional view illustrating each half portion of the connection of the present invention with the insulated electric conductor ends of an electric conductor positioned in one end of the central passage and connected with the electric conductor in each half portion of the connector.

Attention is first directed to FIG. 1 of the drawings wherein the present invention is represented generally by the numeral 7. One electric conductor of a multiple conductor power cable is referred generally by the numeral 6 and includes a conducting core element 5 formed of copper or the like with an insulating dielectric material sheath 8 thereover of suitable elastomer, plastic or combination of the two. The end part 9 of the electric conductor 6 is received within one end 11 of the central longitudinal passage 10 which extends through the male elastomer boot represented generally by the numeral 12.

The other end of the same electric conductor 6 of the pump power cable is provided with a conductor element 5 similar to conductor element 5 of the electric conductor 6 received in the male boot 12. Similarly, it is provided with insulation 8 therearound and its end part **9*a* is received in one end 11*a* of a central longitudinal passage 10*a* extending longitudinally through the elastomer female boot 12*a***.

Each insulated end part 9, **9*a* of each of the multiple insulated conductors of the pump power cables also are provided with a noninsulated end portion 15, 15*a* for securing with the male electric conductor contact pin 25 and female electric conductor socket member 25*a*** to be described in greater detail hereinafter.

Annular, longitudinally extending seal surfaces 30, **30*a* are provided on the male and female boots 12, 12*a*, respectively, to sealingly engage when said male boot and female boot are mated by inserting the annular seal surface 30 in the annular seal surface 30*a* of the female boot. Cooperating lock surface means 35, 35*a* are formed on the male and female boots, respectively, to aid in securing the boots in mated relationship as illustrated in FIG. 2** of the drawings.

Figure 2:
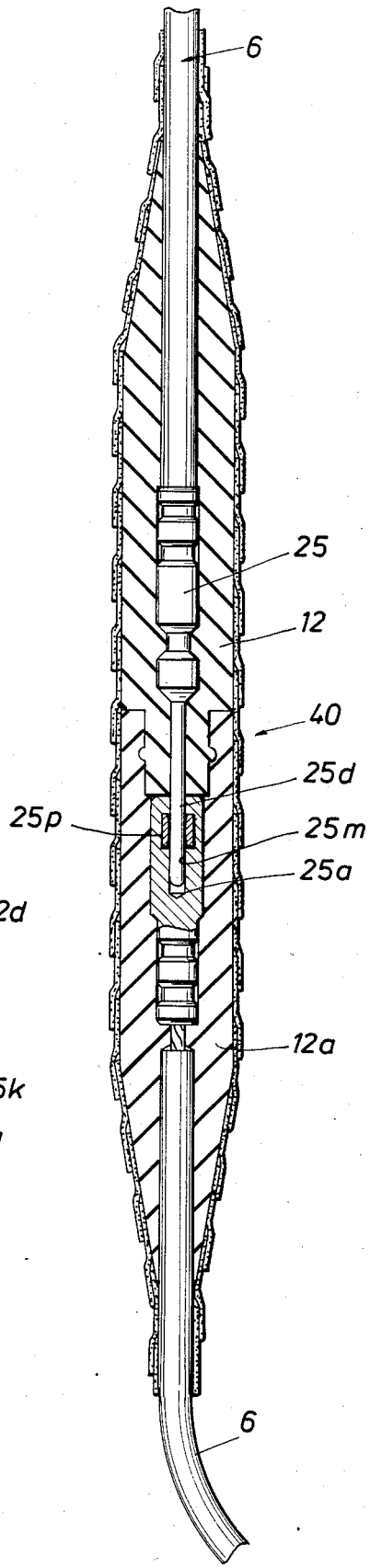
FIG. 2 is a view similar to FIG. 1 but shows the male and female boots mated with the male electric conductor mated with the electric conductor female socket for conduction of electricity through the electric conductor of the power cable. A protective cover is also illustrated in the form of a reinforced material, such as tape or wrapping, wrapped around and enclosing or encapsulating the connector and the adjacent insulated electric conductor ends.

After the electric conductor ends and connector have been assembled as will be described in greater detail herein, an outer cover represented generally at 40 in FIG. 2 is provided to enclose the connector 7 of the present invention to encapsulate it and restrain the elastomer boots against swelling in the fluids in the well bore to thereby increase the effective seal on the conductors and internally of the connector 7 to prevent shorting out.

The central longitudinal passage 10 in male boot 12 is formed by a plurality of longitudinally extending, axially aligned, longitudinal passage portions represented at **10*b*, 10*c*, 10*d*, 10*e* and 10*f*. It can be appreciated that the passage 10 may be formed of any suitable number of longitudinally extending, axially aligned, longitudinal passage portions, but 5** serves the purpose quite well.

Adjacent passage portions have different internal diameters as illustrated in the drawings to thereby form retaining shoulder means spaced longitudinally of the central passage 10, which shoulder means is represented at 10L, **10*k*, 10*m*, 10*n* as illustrated in the drawings. The five adjacent, different diameter passage portions 10*b*–10*f*, inclusive, form the four shoulder means 10L–10*n* as above described. Each of the shoulder means 10L–10*n* inclusive extend annularly and laterally relative to the longitudinal axis of central passage 10** and are preferably provided with sloping or beveled surfaces 16 which are formed at other than vertical relative to the central passage axis and thus assist, along with suitable lubricant in manipulating the male boot 12 over the male electric conductor contact pin 25 as will be described.

The longitudinal passage 10*a* in the female boot 12*a* is also formed by a plurality of longitudinally extending, axially aligned, passage portions represented at 10*b*', 10*p*, 10*q*, 10*r* and 10*s*. Again, adjacent passage portions have different internal diameters as illustrated in the drawings so that internal shoulders 17, 17*a*, 17*b* and 17*c* are formed at the juncture of adjacent, internal diameter passage portions and are spaced longitudinally in the central passage of the female boot.

The shoulder means 17–17*c* extend laterally and annularly of the central passage 10*a* and are preferably beveled as illustrated at 16' for ease of manipulating the female boot into position over the female electric conductor socket 25*a* as will be described. The male electric conducting contact pin 25 and female conducting socket 25*a* are formed of any suitable electric conducting material such as copper or the like and each is formed by a plurality of longitudinally extending portions which are configured to mate with the longitudinally extending, axially aligned, longitudinal passage portions 10*c*–10*f* inclusive in the male boot 12 and passage portions 10*b*, 10*p*–10*s* in female boot 12*a*.

To this end, the male electric conductor contact pin 25 includes annular portions 25*a*, 25*b*, 25*c* and 25*d*. Adjacent longitudinal surface portions on the male conductor contact pin 25 are of the different diameters to form shoulder means 26*e*, 25*f* and 25*g* longitudinally spaced as shown. The shoulder means 25*e*–25*g* inclusive extend annularly and laterally of the male electric conductor contact pin 25 and are preferably provided with bevels or slopes as represented at 26 for ease of positioning the male electric conductor contact pin in a male boot 25 and mating with the stop shoulder formed in central passage 10 as will be described.

The male electric conductor contact pin 25 also includes a passage 26'extending longitudinally thereof at its end adjacent the noninsulated portion 15 of conductor 6 for receiving such noninsulated end of the conductor therein. The portion of the male contact pin 25 adjacent the noninsulated end may be crimped by any suitable means to deform it to grippingly engage and secure the male contact pin 25 to the noninsulated end 15 of the conductor 6 as shown in the drawing.

Similarly, the female electric conducting socket 25*a* is provided with a longitudinal passage 26' for receiving the noninsulated end 15*a* of the conductor 6 which may be crimped as shown to secure the female socket 25*a* and conductor end 9*a* together. The female socket 25*a* is also formed by a plurality of longitudinally exending portions of different diameter as represented at 25*k* and 25L. The portions 25*k* and 25L are of different diameters to form shoulder means 25*m* at their juncture as illustrated in the drawings which may be beveled as previously described for ease of interfitting the female socket 25*a* in the female boot 12*a* as will be described.

A longitudinal passage 25*n* is provided in the other end of the female socket 25*a* communicating with end annular passage 10*s* in female boot 12*a* for receiving the projecting pin end 25*d* of the male socket 25 represented at 25*d* which extends beyond the end of the male boot for insertion into the passage 25*n* to provide electrical contact between the male pin 25 and female socket 25*a* when the male and female boots are mated as illustrated in FIG. 2 of the drawings. The passage 25*n* is provided with any suitable well known arrangement 25*p* as shown to assure electrical contact between the male pin 25*d* and passage 25*n* of the female socket 25*a*.

As previously noted, well pump power cables are generally connected with the pump as the pump is ready to be lowered into the well. In employing the present invention, the male pin 12 and female socket 25*a* are each positioned on noninsulated end 15, 15*a* of the electric conductor cable ends 9 and 9*a*. Any suitable manually operated crimping device may be employed to crimp the portion of the electric conductor male pin and socket adjacent passage 26' in each pin and socket to secure and engage the male contact pin 25 and female socket 25*a* with its electric conductor 6. Thereupon, the male and female boots 12, 12*a* are each pulled over and along the electric conductor male pin 25 and female socket 25*a*, respectively, until the insulated conductor 6 and the electric metal conductor pin and socket with which each conductor is connected is positioned as shown in FIG. 1 of the drawings. If necessary, suitable lubricant may be used in positioning the boots over the pin and socket and associated cable.

Since the longitudinally extending portions of the central passage substantially approximate the length and diameter of the longitudinally extending portions on the respective electric conductor contact pin positioned therein and engaged with the insulated conductor 6, the shoulder means on the central passage of the male boot 12, abut or closely fit adjacent the shoulder means on the metal male contact pin 25 therein to assist in retaining the male contact pin in position and to prevent relative movement between the boot 12 and pin 25 due to well bore pressure.

The female socket shoulders fit adjacent the shoulders in passage 10*a* to retain the female socket therein when subjected to well bore pressures.

It can be appreciated that the foregoing operation is accomplished with a minimum of effort and time and may be accomplished in the field.

The male boot 12 and female boot 12*a* each include a longitudinally extending body portion 12*d*, with each boot 12, 12*a* having tapered outer end surfaces 12*f* extending from the longitudinal body portions 12*b* of each boot downwardly toward the insulated electric conductor 6 received in one end of the central passage. The tapered end surfaces 12' are preferably cylindrical as shown. The internal diameter of the longitudinal passage portion 10*b* and 10*b*' of the male and female boot 12, 12*a*, respectively, is smaller than the outer diameter of the insulated conductor 6 received therein to form an interference fit and seal therewith to inhibit the entry of well fluids.

The male boot 12 is provided with an annular projecting end portion 31 which is of smaller diameter than the longitudinally extending body portion 12*d* and is integral therewith. The juncture of the body portion 12*d* and annular projecting end portion 31 forms stop shoulder means 31*a* at the juncture of the body portion 12*d* and 31 as well as at the end 31*b* of the projecting end.

The end 33 of the female boot 12*a* provides stop shoulder means as does the shoulder means 17*c* formed at the juncture of the longitudinal passage portion 10*s* and longitudinal passage portion 10*r*.

Intermediate the ends of the longitudinal passage portion 10*s* is an arcuate groove 37 for receiving the arcuate, annular rib 38 on the projecting end portion 31 therein to provide lock means to assist in locking the male boot 12 with the female boot 12*a* when as they are mated as shown in FIG. 2 of the drawings. The annular surface 30 on the projecting end 31 and the annular surface 30*a* in the longitudinal portion 10*s* provide an annular seal since the internal diameter of the passage portion 10*s* is of smaller internal diameter than the outer diameter of the projecting pin portion 31 to form an interference fit therebetween.

After the conducting pins have been secured to the cores 5 and the respective boots then positioned over the pin 25 and female socket 25*a*, the boots may then be mated by inserting the projecting end 31 into the female socket 10*s* of the female boot 12*a* so that the stop shoulder means 31*a* abuts the stop shoulder 33 and the stop shoulder means 31*b* abuts the stop shoulder means 17*c*. At the same time, the arcuate recess 37 intermediate the ends of passage 10*s* receives the arcuate annular rib 38 for interlocking relationship between the male and female boot 12, 12*a*.

Thereafter, the protective cover 40 illustrated in FIG. 2 or the form of protective cover illustrated at 40*a* in FIG. 4 may be positioned to encapsulate and enclose the male and female boots and adjacent conductor portions to inhibit swelling thereof due to contact with well fluids, as well as inhibiting disintegration of the connector when the well fluids in the well bore have been pumped down, or when the device is removed which may cause decompression of the boots.

Figure 3:
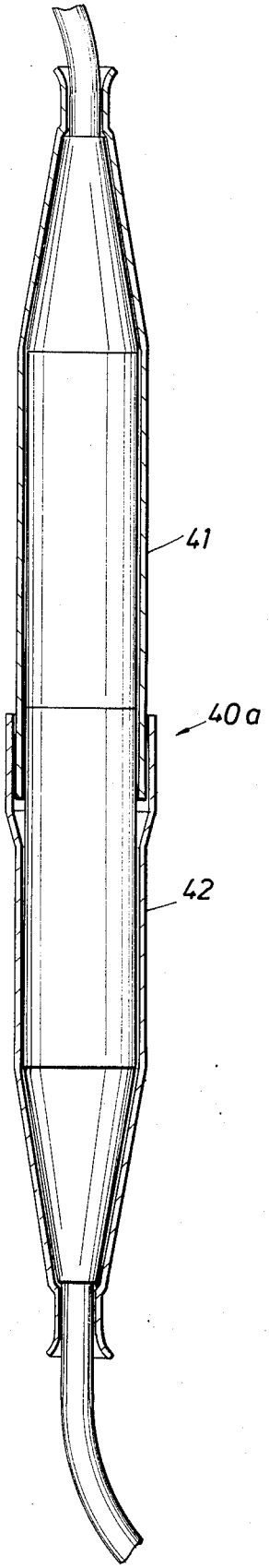
FIG. 3 is a view similar to FIG. 2 but illustrates the connector in elevation with an alternate form of protective cover thereon.

The protective covering 40 is shown in the FIG. 2 illustration as being tape which has suitable reinforcing therein such as metal, glass or other suitable fibers that are not affected by well fluids so that when the tape is wrapped in overlapping relationship over the mated male and female boots 12, 12*a* and around the adjacent ends of the insulated electric conductor as illustrated in FIG. 2, expansion of the male and female boots by absorption of hydrocarbon gas therein is substantially reduced and any swelling of the insulation that may occur in the presence of well fluids, will, in turn, exert a greater sealing effect adjacent the boot and the internal components including the insulated cable extending into each end thereof as well as along the central passage on the male pin. This further increases the longevity of the present connector in well bores, and reduces, if not eliminates, the tendency for the connector to completely disintegrate or explode when the well is pumped down by the well fluid, or when the device is otherwise exposed to atmosphere such as removal from the well. It can be appreciated that the object of a well pump is to pump the fluids down, and where no protective covering is employed as that in the present invention, the connection is subject to deterioration, disintegration and explosion by the attempt of gas in the well to exit from the connector too rapidly. This arrangement enables the gas to seep or breathe out of the elastomer boot slowly and to thereby increase the life of the connector in the well bore.

Where the form of the protective cover assumes metal sleeves as illustrated at 40*a* in FIG. 3, the sleeves 41, 42 may be positioned on the electric conductor 6 along with the boots prior to engaging the male contact pin and female sockets with the respective, noninsulated ends of each electric conductor 6 of a multiple conductor power cable. Thereafter, the sleeves are moved to the position shown in FIG. 3.

When the boots 12, 12*a* are in proper mated relation, they are held in that position due to the matching interlockiing configuration of the male pin 25 in the male boot and matching configuration of the female socket 25*a* in the female boot 12*a* along with the interlocking groove 37 and rib 38. It is to be noted that no adhesives or bonding material between the boots and the internal components including the insulated conductor 6 and electric conductor pins therein are required. The device is sealed due to the interference fits between the insulating cable 6 and the boot and due to the additional of external pressure by the absorbed well fluids in the elastomer boots, tending to cause the elastomer to expand, which elastomers are inhibited, or prevented from expanding and are thereby compressed into tighter sealing relationship with the insulated cable 6 and the internal components of the connector.

FIG. 4 illustrates the present invention when it is to be used in conjunction with multiple electric conductors of a pump power cable which pass through a barrier in or at the top of a well bore such as a tubing or casing head, or such as a production packer in the well bore as shown in FIG. 5. A device termed a penetrator is employed with such barrier, as disclosed and claimed in my copending application Ser. No. 691,558 filed 1/15/85 for "WELL BORE BARRIER PENETRATOR ARRANGEMENT AND METHOD FOR MULTIPLE CONDUCTOR PUMP POWER CABLE".

In FIG. 5, a well bore is represented at W with a production packer P positioned in the casing C therein in a manner well known in the art. The packer body B is provided with slips S to frictionally engage the casing C and positions the packer in the well bore. Annular elastomer packer means as illustrated at 61 on the body B engage with the casing and seal the portion 62 of the well bore above the packer P off from the portion 63 below the packer P. An opening or passage through the body B of the packer P receives a production tubing T which extends from adjacent the production formation of the well to the earth's surface for conducting well fluids therethrough. A second opening 65 through the body B of the packer threadedly receives a penetrator referred to generally at 66 as disclosed in my above referred to copending patent application through which the electric conductors extend, and then through the passage 65 of the packer body B.

Heretofore, substantially difficulty has been encountered in attempting to provide an arrangement to overcome the action of differential pressure exerted on the conductor cables in the well bore W in the portions 62, 63 above and below the well bore packer P as explained in greater detail in my copending application above referred to.

Prior to the time that the power cable PC, tubing T with the pump 80 on the lower end and the packer P are lowered into well bore W, a suitable length of the armor and insulation of power cable PC is removed from around the end thereof which is to be lowered into the well bore. This exposes the individual insulated conductors 70*a*, 71*a* and 72*a* so that a male boot 12 and contact pin 25 may be engaged with each as previously described.

Similarly, a female boot 12*a* and female socket 25*a* is connected with the upper ends of the steel tube 50 enclosed conductors which have been secured in penetrator 66 and extend through packer P. The male and female boots are then joined and encapsulated in cover 40 or 40*a* to provide a connection as shown in FIG. 4 which, when lowered into the well bore, will be positionned on one side of the packer P in well bore portion 62 as shown in FIG. 5.

The lower end of steel tube 50 enclosed conductors 70*a*, 71*a* and 72*a*, which extend through and terminate at the connection on the other side of the packer P, are provided with male boots 12 and male contact pins 25. The pump power cable lead 72 has a suitable length of its armor and insulation removed so that individual insulated conductors 70*a*, 71*a* and 72*a* are exposed for connection with female boots 12*a* and female sockets 25*a* as previously described. These are then encapsulated by cover 40 or 40*a* to provide a connection for each insulated conductor on the other side of packer P as shown in FIG. 4.

The tubing with the packer P and pump on the lower end is then ready to be lowered into the well bore along with the power cable PC which extends from any suitable power source connection at the earth's surface, through the packer P and to the pump 80 in the tubing. It can be appreciated that pump power cable lead 72 will have been also connected to pump 80 before lowering into the well bore.

The steel tubes 50 on the individual conductors which extend through the penetrator 66, described in detail in my copending application, and packer P prevent damage to the conductors and enable the conductors to be secured and sealed as they pass through the barrier formed by packer P even though they are subjected to the differential pressure between well bore portions 62, 63 which tends to try to move them. This differential pressure has caused substantial difficulty with prior art splices and connector arrangements and has rendered them subject to frequent breakdown and replacement. This invention provides a relatively simple connection which overcomes the prior art problems and one which can be applied with ease under adverse conditions.

The steel tubes 50 fit tightly over the insulation 8 to prevent relative movement therebetween. They are impervious and pressure tight against the insulation 8. The abutting end of the tube with the insulator 55 and the female socket as well as the shoulder arrangements in boots 12, 12*a* and pin 25 and socket 25 prevent relative movement of the cables or connector due to differential pressure in the well bore.

The insulator stand off 55 may be formed of ceramic, fiberglass or any other suitable rigid nonconductor and shown as being in the form of a sleeve which abuts the end 50*a* of the steel tube 50 in the female boots 12*a* and the other end 50*b* abuts the female electric conductor socket 25*a* at its other end. The insulated end 9*a* of each conductor end passes through an insulating stand off 55 and the noninsulated end is received in the female socket 25*a* as shown. This prevents the steel tube 50 from engaging the female electric conductor socket 25*a* in the female boot 12*a* and shorting out.

In order to prevent shorting of the electric conductors in the connector 7 of the present invention when they are employed with conductors passing through a well bore barrier, the connector arrangement 7*a* shown in FIG. 4 is employed. The penetrator 66 is schematically illustrated in FIG. 4 as including housing 66*a* which supports seal 66*b* and locking means 66*c* for sealably engaging and securing, respectively, the metal tube 50 which surrounds and encapsulates each of the insulated electric conductors 70*a*, 71*a* and 72*a* between the connection on one side of the barrier to the connection on the other side of the barrier as shown and described in FIG. 5. The securing means 66*c* prevent relative longitudinal movement between the conductors and packer P or between the boots and the conductors.

It will be noted that the connections in the conductors are spaced longitudinally so that each connector may be formed of ample insulation to withstand the electric load under well bore conditions. The offset arrangement of the connectors also enables the present connector arrangement to be readily received in the restricted well bore while providing ample insulation to accommodate the power loads involved.

The connection arrangement of the present invention is effected without the use of cements, adhesives, glues, epoxy or bonding and can be readily and easily applied in the field with field personnel. It eliminates technicians and substantially reduces the time and expense of forming a field connection for a well bore pump power cable, while providing a connection that overcomes the prior art splice and connector problems of well bore pump power cables.

Whenever a connection is made with power cable multiple individual conductors as described herein, the individual conductors are wrapped from the connection to the armored part of the power cable to protect them.

The foregoing disclosure and description of the invention are illustrative and explanatory thereof, and various changes in the size, shape and materials as well as in the details of the illustrated construction may be made without departing from the spirit of the invention.

I claim:

1. A field application connector for slidably positioning over the insulated ends of individual electric conductors to connect the noninsulated ends of each individual conductor of a multiple electric conductor power cable wherein at least one end of each of the individual insulated conductors is enclosed in an impervious, pressure tight tube, the connector comprising:

an elastomer male boot for slidably receiving one of the ends of an individual insulated electric conductor of the power cable;

an elastomer female boot for slidably receiving the other end of the individual insulated electric conductor of the power cable;

each of said boots having:

a longitudinally extending body portion with each boot having tapered outer end surfaces extending from the longitudinal body portion downwardly to the insulated electrical conductor received therein;

a central longitudinal passage therethrough formed by a plurality of longitudinally extending, axially aligned, longitudinal passage portions with adjacent passage portions having different internal diameters to thereby form retaining shoulder means spaced longitudinally in the central passage at the juncture of adjacent passage portions;

said longitudinal passage portions which extend axially of the tapered outer end surfaces of each male and female boot having an inner diameter which is less than the outer diameter of the insulated electric conductor for sealing therebetween when the insulated electric conductor is extended, respectively, into the central passage of each the male and female boot;

annular longitudinally extending seal surfaces engageable when said male boot is inserted in said female boot to seal therebetween; and cooperating stop surface means and lock surface means engageable when said male boot and female boot are in mated, sealing relationship;

a male electric conductor contact pin member to engage the noninsulated end extending from the one end of the insulated electric conductor and positionable in the central passage of said male boot to seal and secure the insulated conductor in said male boot against withdrawal from the male boot due to well bore pressure;

said male electric conductor contact member pin having:

a plurality of longitudinal outer surface portions with adjacent outer surface portions being of different diameter to form shoulder means on said male electric conductor contact pin member whereby said outer surface portions and shoulder means on said male electric conductor contact pin member mate with said longitudinal passage portions and shoulder means of said male boot to retain and seal said male electric conductor contact pin member in said male boot; and an end portion projecting beyond said male boot;

an electric conductor female socket member to engage the noninsulated end extending from the other end of the insulated electric conductor and positionable in the central passage of said female boot to seal and secure the insulated conductor in said female boot against withdrawal from the female boot due to well bore pressure;

said electric conductor female socket member having:

a plurality of longitudinal outer surface portions with adjacent outer surface portions being of different diameter to form shoulder means on said electric conductor female socket member whereby said outer surface portions and shoulder means on said electric conductor female socket member mate with said longitudinal passage portions and shoulder means of said female boot to retain said electric conductor female socket member in said female boot; and a longitudinal passage to receive said end portion of said electric conductor male contact pin member in electric conducting relationship with said electric conductor female socket member;

said electric conductor male contact pin member and said electric conductor female socket member each including a longitudinal opening in one end for receiving the noninsulated ends of the insulated electric conductors, and said electric conductor male contact pin member and said electric conductor female socket member each have a deformable portion for crimping to engage the noninsulated conductor ends;

a protective covering enclosing said male and female boots to inhibit expansion thereof in well bore fluids and thereby increase the sealing effect between said male and female boots and insulated conductor therein and between said mated male and female boots; and a tubular insulating nonconductor positioned between the end of the impervious tube and said electric conductor member secured to the adjacent noninsulated conductor end.

2. A connector for the ends of individual insulated electric conductors of a multiple electric conductor power cable wherein at least one end of each individual insulated conductor is enclosed in an impervious, pressure tight tube, the connector comprising:

male electrical contact member adapted to be connected to the noninsulated end of an insulated electrical conductor of a multiple electric conductor power cable;

female electrical contact member adapted to be connected to the noninsulated end of an insulated electrical conductor of a multiple electric conductor power cable;

elastomer male boot having a central longitudinal passage for slidably and sealably receiving an insulated electric conductor of a multiple electric conductor power cable with said male electrical contact member connected to the noninsulated end thereof;

elastomer female boot having a central longitudinal passage for slidably and sealably receiving an insulated electric conductor of the multiple electric conductor power cable with said female electric contact member connected to the noninsulated end thereof, said female boot constructed to telescopically receive said male boot therewith whereby said male contact member is engaged and retained within said female contact member;

cooperating surface means on said male and female electrical contact members and on said longitudinal passage means of said male and female boots in which said male and female contact members are respectively received whereby said insulated conductors and electrical contact members engaged therewith are retained respectively in said male and female boots;

incapsulation means to cover said telescopically connected male and female boots and the adjacent portion of said insulated conductor extending into each of said boots to prevent swelling of said boots; and a tubular insulating nonconductor positioned between the end of the impervious tube in the central passage and the electrical contact member in said boot connected with the noninsulated electric conductor end.

* * * * *